US009230463B2

(12) United States Patent
Volftsun

(10) Patent No.: US 9,230,463 B2
(45) Date of Patent: Jan. 5, 2016

(54) MESSAGE IN A BOTTLE

(71) Applicant: Lev Volftsun, McLean, VA (US)

(72) Inventor: Lev Volftsun, McLean, VA (US)

( * ) Notice: Subject to any disclaimer, the term of this patent is extended or adjusted under 35 U.S.C. 154(b) by 0 days.

(21) Appl. No.: 14/512,986

(22) Filed: Oct. 13, 2014

(65) Prior Publication Data

US 2015/0027012 A1 Jan. 29, 2015

Related U.S. Application Data

(62) Division of application No. 13/448,539, filed on Apr. 17, 2012, now Pat. No. 8,857,083.

(51) Int. Cl.

| | |
|---|---|
| ***G09F 3/00*** | (2006.01) |
| ***G09F 23/00*** | (2006.01) |
| ***B65D 23/00*** | (2006.01) |

(52) U.S. Cl.

CPC ..... *G09F 23/00* (2013.01); *B65D 23/00* (2013.01); *G09F 3/00* (2013.01); *B65D 2203/00* (2013.01); *Y10T 428/13* (2015.01)

(58) Field of Classification Search

CPC ..... G09F 21/18; B65D 23/14
USPC ..... 40/326, 409; 446/267
See application file for complete search history.

(56) References Cited

U.S. PATENT DOCUMENTS

| | | | | |
|---|---|---|---|---|
| 552,134 | A | 12/1895 | Miller | |
| 687,236 | A | 11/1901 | Ivey et al. | |
| 768,912 | A | 8/1904 | Shook | |
| 2,651,870 | A | 9/1953 | Lipic et al. | |
| 3,256,977 | A | 6/1966 | Pettersen | |
| 4,032,141 | A * | 6/1977 | Tanimura | 273/457 |
| 4,582,498 | A | 4/1986 | Tamada | |
| 4,907,719 | A | 3/1990 | Spotholz et al. | |
| 4,923,429 | A * | 5/1990 | Lewis | 446/197 |
| 5,133,479 | A | 7/1992 | Boyte, Sr. | |
| 5,292,564 | A | 3/1994 | Lee | |
| 5,921,955 | A | 7/1999 | Mazer et al. | |
| 6,073,373 | A | 6/2000 | Haugk et al. | |
| 6,725,589 | B2 | 4/2004 | Braun | |
| 2006/0150450 | A1 | 7/2006 | Azouri | |

FOREIGN PATENT DOCUMENTS

| | | |
|---|---|---|
| JP | 04201853 | 7/1992 |
| JP | 11207046 | 8/1999 |
| JP | 2000335585 | 12/2000 |
| JP | 2007091279 | 4/2007 |
| JP | 2008178641 | 8/2008 |

* cited by examiner

*Primary Examiner* — Joanne Silbermann

(74) *Attorney, Agent, or Firm* — Lieberman & Brandsdorfer, LLC

(57) ABSTRACT

Embodiments of the invention relate to a container with one or more secondary objects housed in the container and configured with indicia to communicate a message. One or more secondary objects in communication with a weight are housed in the container. A combination of the weight and buoyancy characteristics of the secondary object(s) supports floating of the secondary object in the fluid.

16 Claims, 3 Drawing Sheets

MESSAGE IN A BOTTLE

CROSS REFERENCE TO RELATED APPLICATION(S)

This application is a division of application Ser. No. 13/448,539, filed on Apr. 17, 2012,issued as U.S. Pat. No. 8,857,083, and titled "Message In A Bottle," which is hereby incorporated by reference.

FIELD OF THE INVENTION

The present invention relates to an apparatus and method for expressing a message in a fluid. More specifically, the present invention suspends an object in a fluid filled container to convey a message through associated indicia.

BACKGROUND

Delivery of media through a container is known in the art. There are different aspects to the delivery, including placement of media on an external surface of the container and placement of media in an interior compartment of the container. Examples of placement of media on the external surface include securing a banner to an external surface of the container. Placement of a message or ornament in an interior compartment of the container is also known in different embodiments. For example and with respect to fluid filled containers, the fluid is generally transparent and the media floats in the fluid. Accordingly, the message or ornament either on the external surface or within the interior compartment has been used for both communication, entertainment, and advertising.

SUMMARY OF THE INVENTION

The present invention relates to an apparatus for communicating data in a container holding a fluid.

In one aspect of the invention, a container is provided with a body and an aperture in communication with the body. More specifically, the body has both proximal and distal ends, and a wall that defines an interior compartment of the body. The aperture is located adjacent to the proximal end of the container body. The aperture is configured to receive and dispense a fluid held in the interior body compartment. A secondary object is provided and held in the interior compartment. More specifically, the secondary object is provided in communication with a weight, which is configured to hold the secondary object in a floating position in the interior compartment. The floating position is defined by a combination of properties of the weight, fluid, and buoyancy characteristic(s) of the secondary object.

In another aspect, an apparatus is provided with a body, an aperture and a secondary structure. The body is defined by proximal and distal ends, and wall extending between the two ends to define an interior compartment. The aperture is provided in communication with the body, and more specifically adjacent to the proximal end of the body. The aperture is configured to both receive fluid into the interior compartment and to dispense fluid held in the interior compartment. The secondary structure is held in the interior compartment. More specifically, the secondary structure includes a first element and a second element. The first element is in communication with the bottom surface of the body and also has indicia. The second element is adapted to float in the fluid held in the interior compartment. Furthermore, the second element has a weight that through gravity pulls the second element to the bottom surface toward the indicia of the first element.

Other features and advantages of this invention will become apparent from the following detailed description of the presently preferred embodiments of the invention taken in conjunction with the accompanying drawings.

Figure 1:
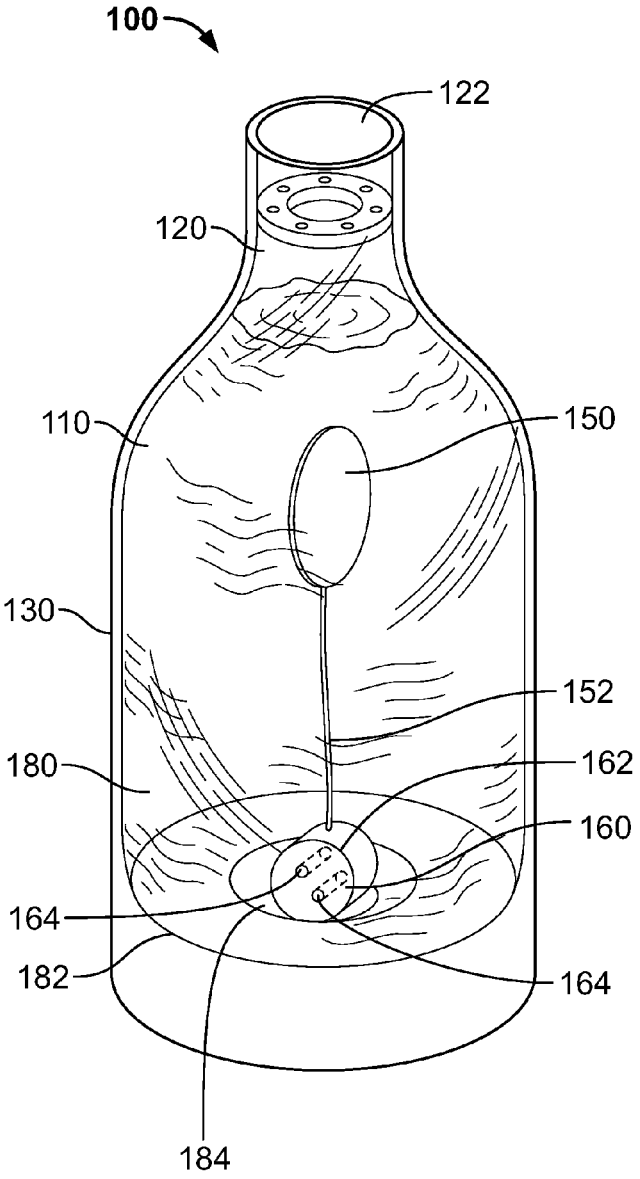
FIG. 1 is an illustration of a sectional view of one embodiment of the container and associated indicia.

The drawings referenced herein form a part of the specification. Features shown in the drawings are meant as illustrative of only some embodiments of the invention, and not of all embodiments of the invention unless otherwise explicitly indicated. Implications to the contrary are otherwise not to be made.

DETAILED DESCRIPTION

As noted, the embodiments described herein pertain to placement of a message or indicia in a container holding a fluid. Prior art configurations of such placements employ a static approach to presentation of the indicia and are not responsive to the fluid and characteristics associated with the fluid. Accordingly, there is a need for a dynamic solution that functions to enable the indicia and presentation thereof to respond to the fluid while conveying a communication associated with the indicia.

It will be readily understood that the components of the present invention, as generally described and illustrated in the Figures herein, may be arranged and designed in a wide variety of different configurations. Thus, the following more detailed description of the embodiments of the apparatus, system, and/or method of the present invention, as presented in the Figures, is not intended to limit the scope of the invention, as claimed, but is merely representative of selected embodiments of the invention.

Reference throughout this specification to "a select embodiment," "one embodiment," or "an embodiment" means that a particular feature, structure, or characteristic described in connection with the embodiment is included in at least one embodiment of the present invention. Thus, appearances of the phrases "a select embodiment," "in one embodiment," or "in an embodiment" in various places throughout this specification are not necessarily all referring to the same embodiment.

Furthermore, the described features, structures, or characteristics may be combined in any suitable manner in one or more embodiments. In the following description, numerous specific details are provided, such as examples of structures for supporting items or indicia containing items in a fluid filled environment to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

The illustrated embodiments of the invention will be best understood by reference to the drawings, wherein like parts are designated by like numerals throughout. The following description is intended only by way of example, and simply illustrates certain selected embodiments of devices, systems, and processes that are consistent with the invention as claimed herein.

A fluid filled environment in communication with an indicia supporting configuration is illustrated in FIG. 1. More specifically, FIG. 1 is a sectional view of one embodiment of the container and associated indicia (100). The container includes an elongated annular shaped body (110) having a proximal end (120), a distal end (180), and an exterior wall (130) extending between the two ends. The exterior wall (130) in combination with the proximal and distal ends (120) and (180), respectively, form an enclosed body, also referred to interchangeably herein as a container. In one embodiment, the exterior wall (130) is comprised of a translucent, transparent, or otherwise visible material to enable viewing of the fluid and any objects contained in the fluid. Although the description is address to an annular shaped body (110), the invention should not be limited to this embodiment. Specifically, the container can take on various shapes and sizes and the description provided herein is for illustrative purposes and should not be considered limiting. The proximal end (120) includes an aperture (122), also referred to herein as a spout, configured to both receive and dispense fluid from the container. In the example shown here, the container contains fluid at a level at or near the aperture (122). A secondary object (150) is housed within the fluid held in the container. The secondary object (150) is in communication with a weight (160). More specifically, a tether (152) is provided to hold the secondary object (150) in communication with the weight (160). Through gravity, the weight (160) is designed to be in communication with the distal end (180) and through buoyancy, the weight (160) in combination with the tether (152) holds the secondary object (150) in a floating position in the fluid.

The distal end (180) of the body (110) has an interior wall (182) that extends from the exterior wall (130) to an indentation (184). The interior wall (182) is shown with a concave shape. However, in one embodiment, the interior wall (182) may have an alternative shape and as such the shape of the interior wall (182) should not be limiting. The indentation (184) is sized to receive the weight (160). The indentation (184) is not an aperture and does not affect the integrity of the body for the functionality of containing a fluid. More specifically, the indentation (184) functions as a resting place for the weight (160). The location of the indentation (184) determines the horizontal position of the secondary object (150). As shown, the secondary object (150) is in communication and held to the weight (160) by a tether (152). More specifically, the secondary object (150) floats in the fluid held in the container through buoyancy, and at the same time is held in a floating position through a combination of the weight (160) and the tether (152). In one embodiment, the weight of the secondary object (150) with respect to both the weight (160) and properties of the fluid enable the secondary object to appear at or near a middle section of the fluid within the container. As the fluid level in the container drops, the position of the secondary object (150) changes as well, and in one embodiment lowers with respect to the lowering of the fluid level. Accordingly, the configuration shown herein enables the secondary object to float within the fluids within the container.

To add to the visual effects of the secondary object (150); both the tether (152) and the weight (160) are translucent or transparent, thereby making both the tether (152) and the weight (160) difficult if not impossible to see. At the same time, the secondary object (150) is comprised of a non-translucent or non-transparent material, thereby making the secondary object (150) visible. In one embodiment, the secondary object (150) may contain indicia to convey a message. Accordingly, the combination of the materials of the tether (152), weight (160), and secondary object (150) provide a visual effect of an object floating in a fluid filled container.

As shown herein, when fluid is provided in the container (120), the weight (160) comes to rest in communication with the indentation (184) and the secondary object floats in the fluid at or near a set position. It is recognized that fluid levels in the container may change as fluid is either added to the container or removed from the container. The secondary object (150) may only extend as far as the length of the tether (152). Conversely, as the fluid level in the container decreases, the position of the secondary object (150) changes, and may lower based on the properties of buoyancy.

In one embodiment, the weight (160) has a body (162) with one or more Secondary apertures (164) extending there through. The secondary apertures (164)of the weight (160), also referred to herein individually as a second aperture, function as a conduit for fluid flow as fluid is dispensed from the container. More specifically, the secondary apertures (164) mitigate any barriers for fluid flow due to the presence of the weight (160) in the container. In one embodiment, the container may change positions during the time of fluid dispensing and with the position of the weight moved from the indentation (184) to the aperture (122). Accordingly, the functionality of the container and associated dispensing is not affected by the presence of the weight (160) in the fluid.

Figure 2:
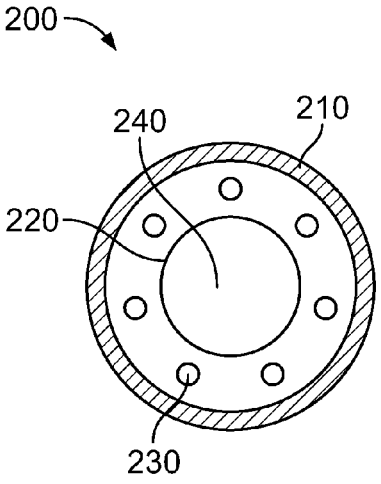
FIG. 2 is an illustration of a cross sectional view of the neck of the container.

FIG. 2 is a cross sectional view (200) of the neck of the fluid container. As shown in FIG. 1, the container is provided with an aperture to receive and dispense fluid. The neck of the container is a portion of the body adjacent to the aperture. As shown herein, the neck (200) has an annular shape, although the invention should not be limited to the specific shape shown herein. The neck (200) has an exterior ring (210) and an interior ring (220), with a plurality of secondary apertures (230) spaced between the two rings, and a primary aperture (240) in communication with the interior ring (220). In one embodiment, the secondary apertures (230) are individually referred to as a third aperture. The primary aperture (240) may also be referred to herein as a spout. The secondary apertures (230) function to enable fluid to be dispensed from the container or fluid to be placed in the container in the event of a blockage of the primary aperture (240). For example, if the container was positioned such that the weight (160) was in communication with the primary aperture (240), fluid flow would be accommodated through the one or more secondary apertures (230).

Figure 2A:
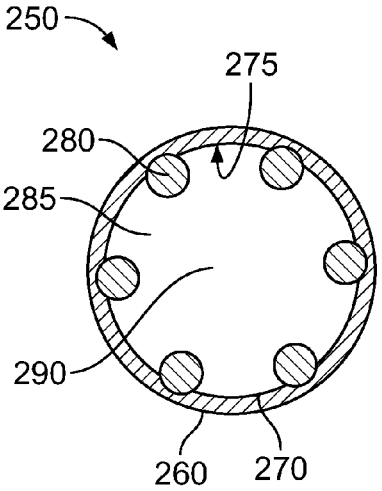
FIG. 2*a* is an illustration of a cross sectional view of another embodiment of the neck of the container.

FIG. 2*a* is a cross sectional view (250) of another embodiment of the neck of the fluid container. As shown in FIG. 1, the container is provided with an aperture to receive and dispense fluid. The neck of the container is a portion of the body adjacent to the aperture. As shown herein, the neck (250) has an annular shape, although the invention should not be limited to the specific shape shown herein. The neck (250) has an exterior ring (260) and an interior ring (270), with a plurality of extensions (280) spaced about an interior surface (275) of the interior ring (270). A primary aperture (290) is provided in communication with the interior ring (270). The primary aperture (290) may also be referred to herein as a spout. The extensions (280) function to enable fluid to be dispensed from the container or fluid to be placed in the container in the event of a blockage of the primary aperture (290). For example, if the container was positioned such that the weight (160) was in communication with the primary aperture (290), fluid flow would be accommodated through the one or more secondary apertures (285) formed between each adjacently space extension (280).

Figure 3:
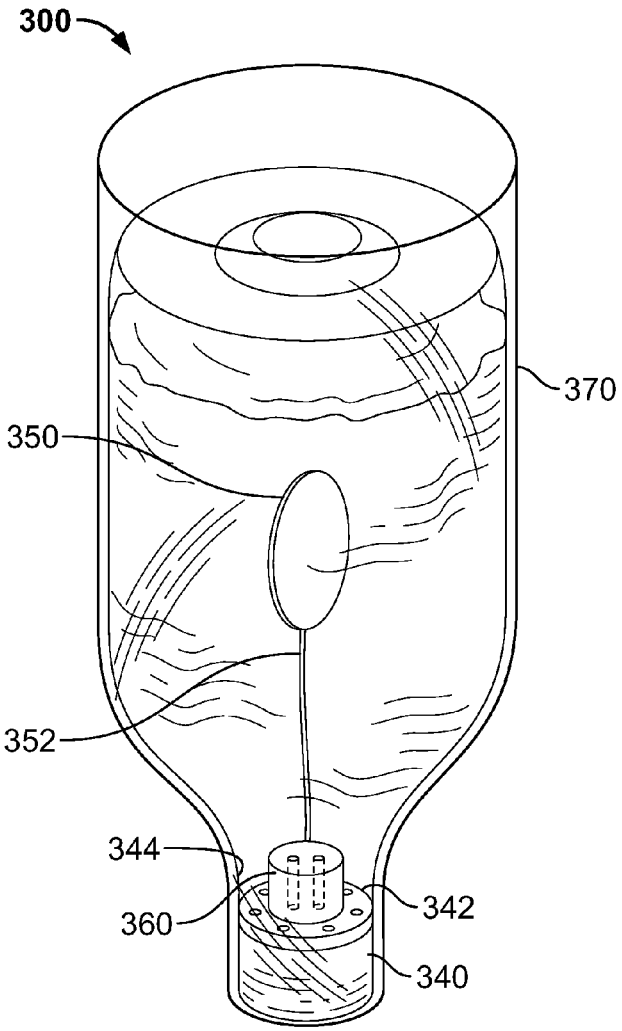
FIG. 3 is an illustration of a sectional view of the container in an alternate position.

FIG. 3 is a sectional view (300) of the container in an alternate position. More specifically, the position shown herein is a fluid dispensing position with the weight (360) in communication with the primary aperture (340) and the secondary object (350) in communication with the weight (360) through a tether (352). The primary aperture (340) is shown herein with one or more secondary extensions (342) spaced about an interior surface perimeter (344) of the primary aperture (340) and extending into an interior portion of the body (370). The surface perimeter (344) between each adjacent secondary extension (342) forms a secondary aperture (not shown). The secondary aperture functions to enable fluid to be dispensed from the container or fluid to be placed in the container in the event of a blockage of the primary aperture (340). Accordingly, through the configuration provided in FIG. 2 or FIG. 3, the primary aperture (240) or (340), respectively, may be modified and configured with one or more apertures to function as a secondary conduit to dispense fluid from the container or to place fluid into the container.

Figure 4:
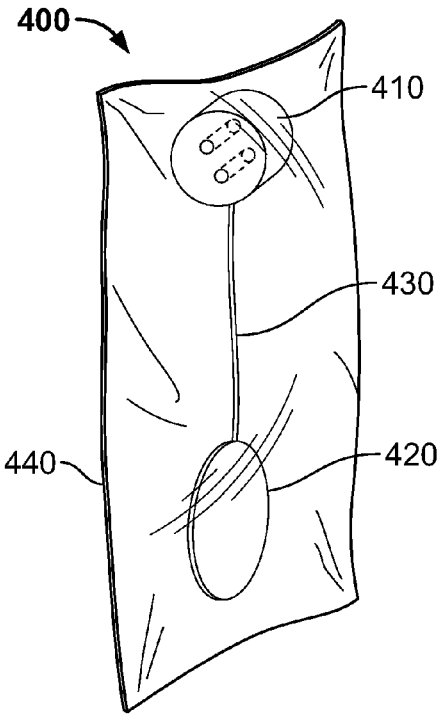
FIG. 4 is an illustration of the weight, secondary object, and tether combination in the form of a kit.

In each of FIGS. 1, 2, and 3, a weight in communication with a secondary object through a tether is shown housed in a container. The container and/or the weight may be configured with a secondary aperture to enable fluid to enter and exit the container in case of a full or partial blockage of the primary aperture. However, in one embodiment, the weight, secondary object, tether combination may be configured as an accessory to be placed in a container. The weight, secondary object, tether combination may be in the form of a kit packaged in a first form sized smaller than the primary aperture. FIG. 4 is a block diagram of the kit (400). As shown, the weight (410), secondary object (420), and tether (430) combination referred to herein as a kit is enclosed in a wrapping (440). The wrapping (440) is sized smaller than the primary aperture of the container. In one embodiment, the wrapping (440) holds the components of the kit in a compressed format. The kit may be placed in the container interior with the wrapping intact (440), and a tool may be extended into the container to remove the wrapping (440), thereby enabling the elements of the kits to expand to their non-compressed format. Accordingly, the kit shown herein is one embodiment for placement of the secondary object and associated weight into the container interior.

Similarly, in another embodiment, the secondary object (420) and the tether (430) may be sized in a non-compressed format to fit through the primary aperture of the container, with a non-compressed size of the weight (410) greater than the size of the primary aperture. The weight (410) may be comprised of a malleable or partially malleable material to enable the weight to comprise different sizes and shapes. In this embodiment, the secondary object (420) and tether (430) may be placed in the container together with the weight (410) by changing the shape of the weight to a smaller size through the primary aperture. For example, in one embodiment, the material of the weight (410) may be comprised of a shape memory alloy enabling the weight (410) to return to its non-compressed size following placement of the weight into the interior of the container. At the same time, the malleability of the weight (410) enables it to be removed from the container. For example, if there was a need or desire to remove the secondary object (420), tether (430), and/or weight (440), the malleable characteristics of the weight would enable it to be removed. Accordingly, the material of the weight (410) may enable the placement and/or removal of the weight with respect to the container.

Figure 5:
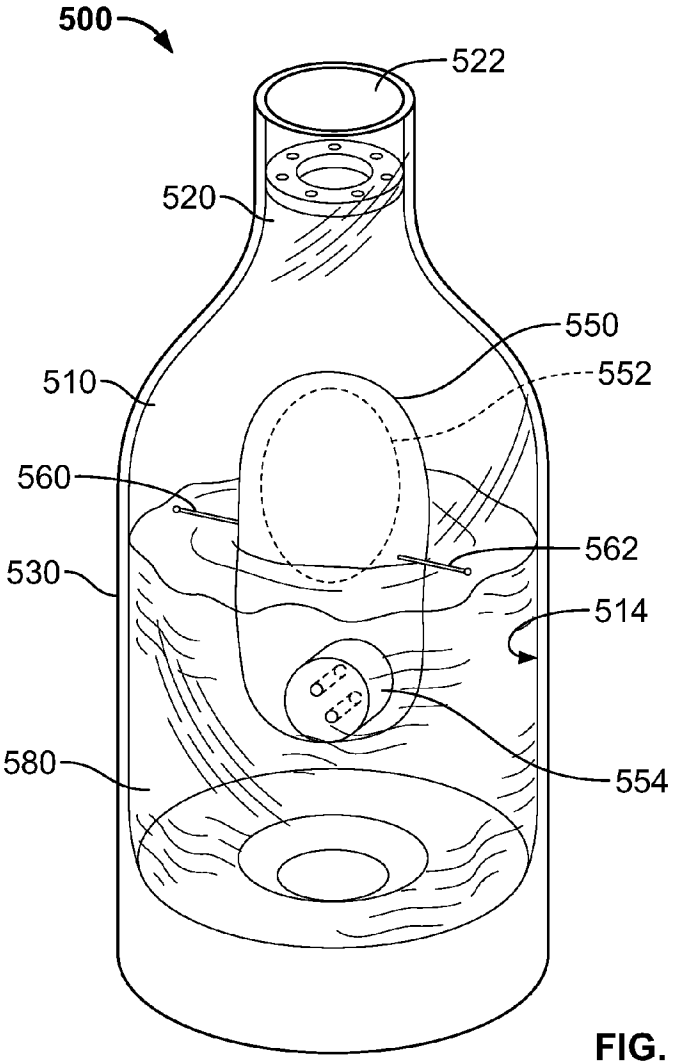
FIG. 5 is a sectional view of an embodiment of the container and associated indicia

There are different forms for supporting the secondary object in the fluid of the container. By tethering the secondary object to a weight and having the weight rest in an indentation, the secondary object continues to float in the fluid with a limited range of motion. More specifically, the range is limited by the tether. FIG. 5 is a sectional view of an embodiment of the container and associated indicia (500). Similar to FIG. 1, the container includes an elongated annular shaped body (510) having a proximal end (520), a distal end (580), and an exterior wall (530) extending between the two ends. The exterior wall (530) in combination with the proximal and distal ends (520) and (580), respectively, form an enclosed body, also referred to interchangeably herein as a container. In one embodiment, the exterior wall (530) is comprised of a translucent, transparent, or otherwise visible material to enable viewing of the fluid and any objects contained in the fluid. Although the description is address to an annular shaped body (510), the invention should not be limited to this embodiment. Specifically, the container can take on various shapes and sizes and the description provided herein is for illustrative purposes and should not be considered limiting. The proximal end (520) includes an aperture (522), also referred to herein as a spout, configured to both receive and dispense fluid from the container.

A secondary compartment (550) is housed within the fluid held in the container. The secondary compartment (550) includes a pocket (552) and a weight (554). The pocket (552) is configured to receive a secondary fluid such as air, gas, etc. A set of tethers (560) and (562) are provided in communication with the secondary compartment (550). The set of tethers (560) and (562) extend away from the secondary compartment (550) towards an interior wall (514) of the container. The weight (554) functions with gravity to pull the secondary compartment (550) in a downward direction. At the same time, the pocket (552) and the fluid therein functions to enable the secondary compartment (550) to be suspended in the fluid held in the container. As a result, the weight (554) together with the buoyancy of the fluid in the pocket (552) enables the secondary compartment to float within fluid held in the container. In one embodiment, the secondary compartment (550) may contain indicia to convey a message. More specifically, by providing the material of the container with a translucent or transparent material and providing the fluid in the container with a light color spectrum, the indicia on the secondary compartment (550) is visible from outside of the container. Accordingly, the properties of the fluid, the container, and the secondary compartment support communication of a message from indicia in communication with the secondary compartment (550).

The tethers (560) and (562) support the buoyancy of the secondary compartment (550) in the fluid filled container. Specifically, the tethers (560) and (562) are in communication with the secondary compartment (550) but do not come into contact with the interior wall (514). By preventing this contact, the tethers (560) and (562) support the buoyancy of the secondary compartment (550). The tethers (560) and (560) prevent the secondary compartment (550) from clinging to the interior wall (514) due to surface tension. In one embodiment, the tethers are comprised of a transparent or translucent material to mitigate their visibility within the fluid. Accordingly, the tethers (560) and (562) contribute to the functionality and placement of the secondary compartment (550) in the container.

Figure 6:
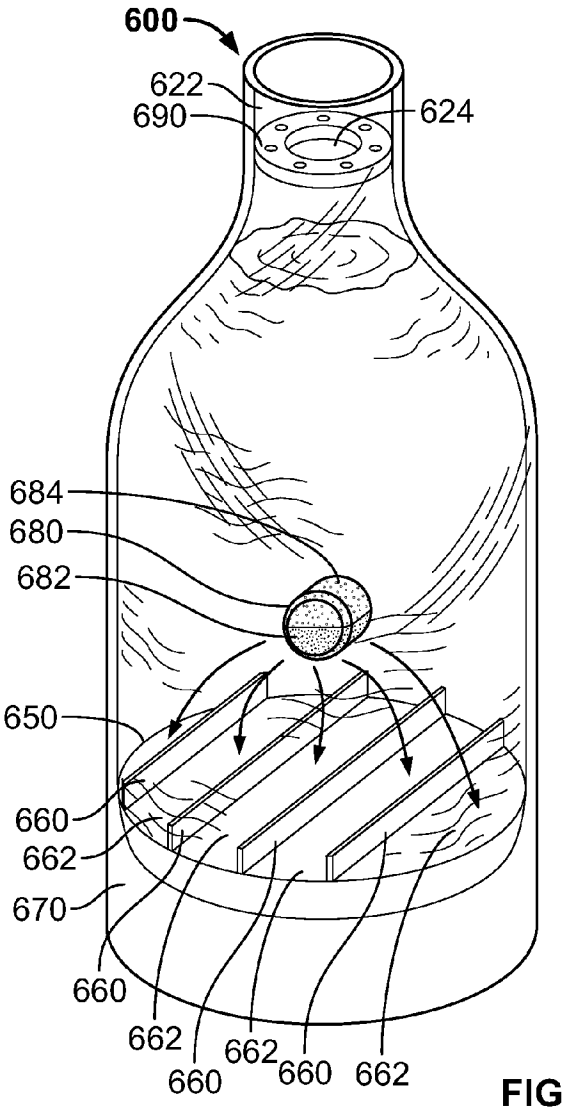
FIG. 6 is a sectional view of an embodiment of the container and associated indicia.

The container of FIG. 5 may be modified with an alternative secondary configuration. FIG. 6 is a sectional view of an embodiment of the container and associated indicia (600). Portions of the container with the same functionality will be referred to with a parallel set of identifying numbers. The container is provided with a secondary structure (650) configured to rest on a bottom interior surface (670) of the fluid filled container. The secondary structure (650) is relatively flat and is sized with an area smaller than the area of a cross section of the container. In one embodiment, the secondary structure (650) includes a plurality of raised sections (660) to create spaces (662) to receive secondary objects (680). As shown, one or more secondary objects (680) are provided in the container. Each secondary object (680) is comprised of a weight (682) and indicia (684).

The weight (682) of the secondary object (680) pulls the secondary object towards the bottom of the container. The indicia (684) presented on the secondary object (680) is employed to convey a message. In one embodiment, the secondary object (680) may have a first indicia on a first side and a second indicia on a second side, with the first and second indicia being different. Similarly, in one embodiment, the secondary object may have additional sides with indicia on each side, or the secondary object may be a three dimensional surface with indicia extending across the surface. The weight (682) causes the secondary object (680) to fall through the fluid and communicate with the secondary structure (650). More specifically, at such time as the secondary object (680) is in communication with the secondary structure (650), only one of the first and second indicia will be visible as the non-visible indicia will be in communication with the secondary structure. The visible indicia are employed to convey a message. Similarly, the position of the visible indicia with respect to the spaces (662) of the secondary structure (650) may also be employed to convey a message. In one embodiment, the secondary object (680) or a plurality of secondary objects may be employed with a set of rules for entertainment purposes.

It may be desirable to hold the secondary object(s) (680) in the container. A secondary material (690) may be provided in communication with the primary aperture (622). The material (690) functions as a barrier for the secondary objects (680). More specifically, the material (690) includes a secondary aperture (624) with a size smaller than the secondary object (680), thereby preventing the secondary object (680) from being dispensed with the fluid. In one embodiment, an alternative barrier may be employed to function for retaining the secondary object (680) in the container interior while enabling fluid to be dispensed from the container. Accordingly, the scope of the invention should not be limited to this particular embodiment.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope. Accordingly, the scope of protection of this invention is limited only by the claims and their equivalents.

I claim:

1. An apparatus comprising:

a body, having a distal end and a proximal end and a wall to define an interior compartment;

an aperture adjacent to the proximal end, the aperture configured to receive and dispense a fluid held in the interior compartment of the body;

a secondary structure held in the interior compartment, the secondary structure in communication with the distal end;

one or more secondary objects, each secondary object comprising indicia and a weight, the weight being configured to pull the secondary object to the distal end and in communication with the secondary structure; and a secondary material in communication with the aperture to form a barrier for fluid entering or exiting the aperture, the secondary material having at least one secondary aperture, wherein the at least one secondary aperture is smaller than the secondary object in the fluid.

2. The apparatus of claim 1, wherein a position of the indicia of the secondary object with respect to the secondary structure conveys a message.

3. The apparatus of claim 1, wherein the secondary structure comprises a plurality of raised sections to create one or more openings, the openings sized to receive the secondary objects.

4. The apparatus of claim 1, wherein the secondary object comprises at least two sides, the sides comprising indicia unique to each side.

5. The apparatus of claim 1, wherein the secondary object comprises a three dimensional surface, with the indicia extending across the surface.

6. The apparatus of claim 1, wherein, upon being in communication with the secondary structure, the indicia of the secondary object conveys a message.

7. The apparatus of claim 6, wherein the indicia comprise visible indicia and non-visible indicia, the visible indicia conveying the message upon the non-visible indicia communicating with the secondary structure.

8. The apparatus of claim 1, wherein the secondary structure being in communication with the bottom surface of the body comprises the secondary structure resting on the bottom surface on the body. with the secondary structure, the indicia of the secondary object conveys a message.

9. A container comprising:

a body, having a distal end and a proximal end and a wall to define an interior compartment;

an aperture adjacent to the proximal end, the aperture configured to receive and dispense a fluid held in the interior compartment of the body;

a secondary structure held in the interior compartment, the secondary structure in communication with the distal end;

one or more secondary objects, the secondary object comprising indicia and a weight, the weight being configured to pull the secondary object to the distal end and in communication with the secondary structure; and a secondary material in communication with the aperture to form a barrier for fluid entering or exiting the aperture, the secondary material having at least one secondary aperture, wherein the at least one secondary aperture is smaller than the secondary object in the fluid.

10. The container of claim 9, wherein a position of the indicia of the secondary object with respect to the secondary structure conveys a message.

11. The container of claim 9, wherein the secondary structure comprises a plurality of raised sections to create one or more openings, the openings sized to receive at least one of the secondary objects.

12. The container of claim 9, wherein the secondary object comprises at least two sides, the sides comprising indicia unique to each side.

13. The container of claim 9, wherein the secondary object comprises a three dimensional surface, with the indicia extending across the surface.

14. The container of claim 9, wherein, upon being in communication with the secondary structure, the indicia of the secondary object conveys a message.

15. The container of claim 14, wherein the indicia comprise visible indicia and non-visible indicia, the visible indicia conveying the message upon the non-visible indicia communicating with the secondary structure.

16. The container of claim 9, wherein the secondary structure being in communication with the bottom surface of the body comprises the secondary structure resting on the bottom surface on the body.

* * * * *